US009120639B2

(12) United States Patent
Kuriyama et al.

(10) Patent No.: US 9,120,639 B2
(45) Date of Patent: Sep. 1, 2015

(54) DOCUMENT PROCESSING DEVICE AND DOCUMENT PROCESSING METHOD

(75) Inventors: Jun Kuriyama, Yokohama (JP); Fumio Koyama, Tokyo (JP)

(73) Assignee: Primagest, Inc., Kanagawa (JP)

( * ) Notice: Subject to any disclaimer, the term of this patent is extended or adjusted under 35 U.S.C. 154(b) by 0 days.

(21) Appl. No.: 14/359,174

(22) PCT Filed: Nov. 17, 2011

(86) PCT No.: PCT/JP2011/076545
§ 371 (c)(1),
(2), (4) Date: Aug. 25, 2014

(87) PCT Pub. No.: WO2013/073037
PCT Pub. Date: May 23, 2013

(65) Prior Publication Data

US 2015/0084271 A1 Mar. 26, 2015

(51) Int. Cl.

| | |
|---|---|
| ***B65H 31/34*** | (2006.01) |
| ***B65H 29/40*** | (2006.01) |
| ***B65H 29/58*** | (2006.01) |
| ***B65H 31/10*** | (2006.01) |
| ***B65H 29/68*** | (2006.01) |
| ***B65H 99/00*** | (2006.01) |

(52) U.S. Cl.
CPC ..... *B65H 31/34* (2013.01); *B65H 29/40* (2013.01); *B65H 29/58* (2013.01); *B65H 29/68* (2013.01); *B65H 31/10* (2013.01); *B65H 99/00* (2013.01); *B65H 2301/333* (2013.01); *B65H 2301/44765* (2013.01); *B65H 2404/656* (2013.01); *B65H 2405/113* (2013.01); *B65H 2801/48* (2013.01)

(58) Field of Classification Search
CPC ..... B65H 2301/333; B65H 2301/44765; B65H 29/40; B65H 29/68; B65H 31/34
USPC ..... 271/315
See application file for complete search history.

(56) References Cited

U.S. PATENT DOCUMENTS 4,605,211 A * 8/1986 Sonobe ..... 270/58.17
4,787,521 A 11/1988 Utsumi et al.

(Continued)

FOREIGN PATENT DOCUMENTS

JP 61-140463 Y 6/1986
JP 03-267260 Y 11/1991

(Continued)

OTHER PUBLICATIONS

International Search Report for PCT/JP2011/076545 mailed Dec. 20, 2011, 4 pages.

*Primary Examiner* — Patrick Cicchino
(74) *Attorney, Agent, or Firm* — Brown & Michaels, PC

(57) ABSTRACT

There is provided a document processing device and a document processing method capable of aligning and loading documents being transported surely and at a high speed. The document processing device includes: a document inverter for inverting a transport direction of documents being transported; a first guide that is provided in nearly the same direction as the transport direction positions document stacked layers when stacking documents inverted by the document inverter; a second guide that is provided to further tilt at a predetermined angle than orthogonal angle to the transport direction and capable of guiding the transported documents in the first guiding means direction, positions document stacked layers when stacking documents inverted by the document inverting means in conjunction with the first guiding means; and a holder for loading and holding the documents positioned and stacked by the first guide and the second guide. The second guide is constituted by a flat transported document abutting surface capable of making ends of the documents being transported slide down in a positioned state.

6 Claims, 3 Drawing Sheets

(56) References Cited

U.S. PATENT DOCUMENTS

| | | | | |
|---|---|---|---|---|
| 5,188,353 | A * | 2/1993 | Parks | 271/184 |
| 5,409,201 | A * | 4/1995 | Kramer | 270/58.13 |
| 6,575,461 | B1 * | 6/2003 | Rider | 271/315 |
| 2003/0146569 | A1 * | 8/2003 | Monch | 271/315 |
| 2014/0015190 | A1 * | 1/2014 | Huang et al. | 271/3.19 |

FOREIGN PATENT DOCUMENTS

| | | | |
|---|---|---|---|
| JP | 2000-020611 | | 1/2000 |
| JP | 2002-167106 | A | 6/2002 |
| JP | 2003-002517 | Y | 1/2003 |
| JP | 2003-089465 | A | 3/2003 |
| JP | 2008-290879 | A | 12/2008 |

* cited by examiner

Diagram viewed from the side

Diagram viewed from the top

DOCUMENT PROCESSING DEVICE AND DOCUMENT PROCESSING METHOD

TECHNICAL FIELD

The present invention relates to a document processing device and a document processing method capable of reliably aligning and stacking documents being transported. More specifically, it relates to a document processing device and a document processing method capable of collectively processing various kinds of documents concerning various types of business, for example.

BACKGROUND ART

Recently, a device for processing at high speed documents, slips, and forms, such as business forms, is in demand as services diversify. The conventional device of this kind generally processes by sorting fixed sized business forms in advance, and assumed that the forms transported along a transport path drop without error by merely dropping them as is into a stacker (Patent Document 1).

Therefore, it is considered that the loaded documents in the stacker are aligned by controlling the timing of descending an elevator of the high-capacity stacker and thereby making a fixed distance to the top surface of the documents stored in the stacker.

Moreover, documents need to be neatly aligned before binding even with a bookbinding machine, and therefore a dedicated sheet aligning mechanism is provided. Documents are aligned by this sheet aligning mechanism of jogging and aligning them. More specifically, a sheet aligning guide is auto-configured in conformity with the paper size of documents to be processed, and the four sides of the documents fed from a gathering machine are jogged and aligned by the sheet aligning guide a set number of times so as to position them.

Furthermore, while transporting and processing in a mixed state without pre-restricting size, thickness etc. of business forms to be processed is in demand, such a device capable of processing a wide variety of documents is limited to a document processing device already provided by the present applicant.

PRIOR ART DOCUMENTS

Patent Documents

Patent Document 1: JP 2000-20611A

DISCLOSURE OF THE INVENTION

Problem to be Solved by the Invention

However, merely dropping business forms transported along a transport path as is into a stacker from the transport path always generates misalignment in all directions, and when aligned documents are desired, the documents must be aligned by a separate manual procedure thereafter.

Moreover, alignment of documents in a bookbinding machine requires a dedicated sheet aligning function, which jogs and aligns from the four sides of the documents using a guide; however, it cannot avoid failures such as bending or not aligning unfirm documents or a large number of loaded documents even if jogging and aligning is performed. Furthermore, it is a function limited to special purposes where a single sized paper can be processed but documents of different sizes cannot be mixed.

Particularly, when transporting and processing without pre-limiting size and thickness of business forms to be processed in the case where a wide variety of documents are mixed, size and thickness of the business forms being transported to the stacker are not fixed, and the forms stored in a stacker are loaded further misaligned in all directions.

The present applicant has provided a separate dedicated sheet aligning device, where documents to be aligned are put through this sheet aligning device. This sheet aligning device sets documents to be aligned in a document holding part slightly tilted toward a standing positioning guide (for example, a two-side positioning guide for positioning two sides of documents), applies small vibrations to all of the tilted loaded documents, thereby reducing rubbing between the loaded documents and aligning them such that they conform with the positioning guide surface along the tilt.

When carrying out such an operation for a large amount of documents, it becomes an extremely large work load and may be a bottleneck of working efficiency in some cases.

Means of Solving the Problem

The present invention has been devised to resolve the above problems, and aims to provide a document processing device and a document processing method capable of aligning documents without dispersion when loading the documents on a stacker.

The following configuration, for example, is provided as a means for achieving this aim. Namely, a document processing device, which is provided downstream from a document transport path and successively loads documents being transported, said document processing device comprising: a first guiding means that is provided in nearly the same direction as a transport direction and positions documents when stacking the documents being transported through the document transport path; a second guiding means that is provided so as to nearly intersect the transport path from a base of the first guiding means side, halts transport of the documents being transported, and positions a front end side of the documents, and is provided to further tilt at a predetermined angle than orthogonal angle to the transport direction; and a holding means for loading and holding the documents positioned by the first guiding means and the second guiding means, wherein the second guiding means guides the documents being transported with a first abutting part as a base point to the first guiding means side, positions the documents using an abutting side to the first guiding means and abutting side to the second guiding means, and loads the documents on the holding means.

Moreover, it is characterized by further including, for example, a lowering guiding means constituted by a tabular abutting surface which abuts a front end side of the transported documents such that when stacking on the holding means the documents positioned by the first guiding means and the second guiding means, the documents being transported slide down in the state that the front end side of the documents is positioned.

Furthermore, it is characterized by further including, for example, a document inverting means for inverting a transport direction of the documents being transported along the document transport path. The documents inverted by the document inverting means are transported to the second guiding means.

Yet further, it is characterized in that, for example, the document inverting means has a plurality of spiral teeth boards, which have document clamping nail parts extending a constant length in a spiral form from the vicinity of the central part of a disc-like board, formed along the entire perimeter at predetermined intervals and rotatable corresponding to document width, clamps the documents being transported between upper document clamping nail parts of the spiral teeth boards so as to rotate the documents, controls rotation of the documents at the second guiding means position, lowers the documents to the holding means deployed at the bottom, and detaches the documents from the document clamping nail parts.

Yet further, it is characterized in that, for example, a document abutting surface of the second guiding means is configured by a metal plate having a buffer material arranged on the back surface and a polished front surface. It is also characterized in that the holding means loads the documents and controls such that distance between the top surface of the documents that are moved up and down to be loaded and a position where the documents start lowering of the aforementioned processing is kept within a predetermined range.

A document processing method for a document processing device that is provided downstream from a document transport path and successively loads documents being transported, said method comprising: positioning a first side of documents by a first guiding means provided in nearly the same direction as a transport direction when stacking the documents being transported through the document transport path; halting transport of the documents being transported by a second guiding means that is provided to nearly intersect transporting on a front end side of the documents, halts transport of the documents being transported, positions a front end side of the documents, and is provided to further tilt at a predetermined angle than orthogonal angle to the transport direction; and guiding to the first guiding means side the documents being transported with a transported document abutting part on a front end side that is upstream in the transporting direction of the second guiding means as a base point, positioning the documents using an abutting side to the first guiding means and abutting side to the second guiding means, and loading the documents.

It is also characterized by, for example, transporting direction of the documents being transported are inverted by a document inverting means for inverting transporting direction of the documents being transported along the document transport path, and transport of the inverted documents is halted by the second guiding means.

It is also characterized by, for example, when loading the documents, control is performed such that distance between the top surface of the documents that are moved up and down to be loaded and a position where the documents start lowering of the aforementioned processing is kept within a predetermined range.

Results of the Invention

According to the present invention, a document processing device and a document processing method capable of aligning and loading documents neatly and at a high speed can be provided. Moreover, even in the case where documents having various specifications are mixed, the documents can be aligned and loaded neatly and at a high speed.

DESCRIPTION OF EMBODIMENTS

Figure 1A:
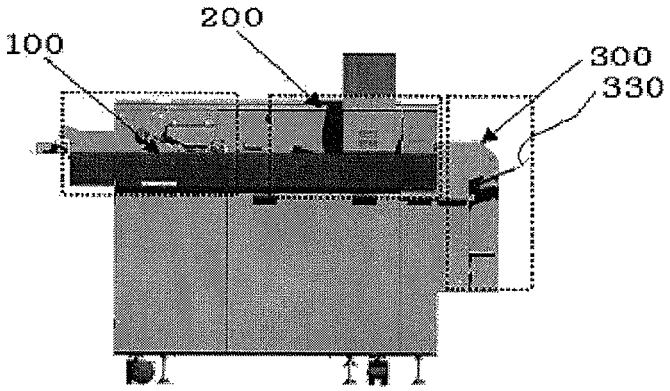
FIGS. 1A and 1B are an external view illustrating an entire configuration of a document processing device of an embodiment according to the present invention.
Figure 1B:
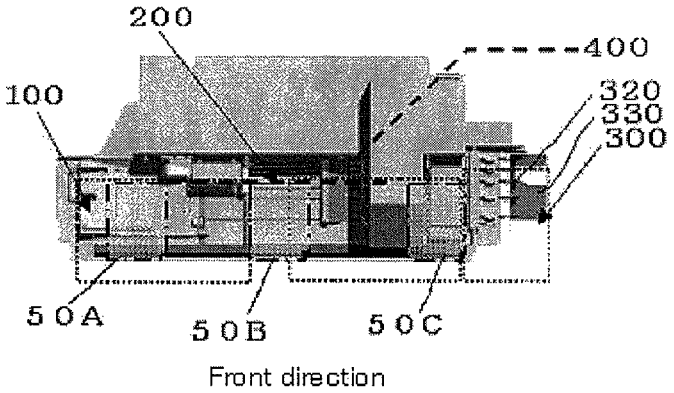

An embodiment of the present invention is explained in detail with reference to attached drawings hereafter. To begin with, an entire configuration of a document processing device of the embodiment according to the present invention is explained with reference to FIGS. 1A and 1B. FIGS. 1A and 1B are a diagram for explaining the entire configuration of the document processing device of the embodiment according to the present invention. FIG. 1A is a front view seen from the front of the device, and FIG. 1B is a top view seen from the top surface, illustrating a state where documents to be processed are transported along a transport path.

As shown in FIGS. 1A and 1B, the document processing device according to the present embodiment is configured by a paper feeder (feeder) 100, a reader 200, and a paper ejector (stacker) 300. It has a transport path for transporting documents from the paper feeder 100 to the paper ejector 300, and performs imaging and sorting of documents, loading of transported documents, etc.

The paper feeder 100 separates documents to be processed (documents such as business forms) one by one every time and supplies each of them to the reader 200. The reader 200 records front surfaces and back surfaces of the transported documents, takes images of them, and processes the resulting document images. The documents read by the reader 200 are transported along the transport path to the paper ejector 300 described in detail later.

In FIG. 1B, reference numeral 50A denotes documents that have been separated by the paper feeder 100 and transporting thereof along the transport path has started, reference numeral 50B denotes documents to be transported from the paper feeder 100 to the reader 200, and reference numeral 50C denotes documents to be transported from the reader 200 to the paper ejector 300.

In this chain of operations, stacking documents in the paper ejector 300 without changing order of the transported and processed documents is desired. This requires a function of inverting documents to be processed during the time that they are separated by the paper feeder 100 and then loaded on an elevator tray 330, which is a holding means for holding documents of the paper ejector 300. In this embodiment, documents are inverted by an inversion wheel 320 as a document inverting means of the paper ejector 300.

Note that reference numeral 400 denotes a side guide, which is standing on one side of the transport path, for positioning a side of documents when stacking the documents. Documents being transported are applied a force for gathering them toward the side guide 400 and transported to the paper ejector 300 while being positioned by the side guide 400.

A characteristic of this embodiment is a mechanism of the paper ejector 300 having the four following parts, whereby documents that are ejected and stacked by this characteristic mechanism are neatly aligned and loaded at a high speed even when, for example, documents having various specifications are mixed.

(1) Guiding Mechanism for Rotating Transported Documents

In order to align the documents on the elevator tray 330 not relying only on the empty weight of the documents, this mechanism has a configuration of applying force in directions that the documents to be stacked are pressed on two required sides.

(2) Mechanism for Reducing Repulsion Associated with Transporting of Documents

While this mechanism is not always required, it has such a configuration on a transport control plate, which halts transport of documents inverted and transported by the configuration of (1), as absorbing the impact of the documents and thereby reducing repulsive force.

(3) Dropping Guide Mechanism

This mechanism has a configuration that keeps at least the front side of the documents, for which the transport control plate has halted further transport thereof, in a held state (abutting state), lowers them and applies force thereupon in a stacking direction.

(4) Tray Height Control Mechanism

This is a mechanism to control height of the elevator tray 330, when the documents held by the inversion wheel 320 described in detail later are set apart from the inversion wheel 320, so as to have a constant distance between the top surface of the documents loaded on the elevator tray 330 and the position of the document when it is separated from the inversion wheel 320.

Figure 2A:
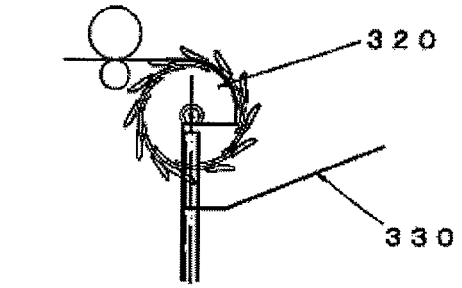
FIGS. 2A and 2B are a diagram mainly explaining functions of a transporting surface of a paper ejector of the document processing device according to the present embodiment.
Figure 2B:
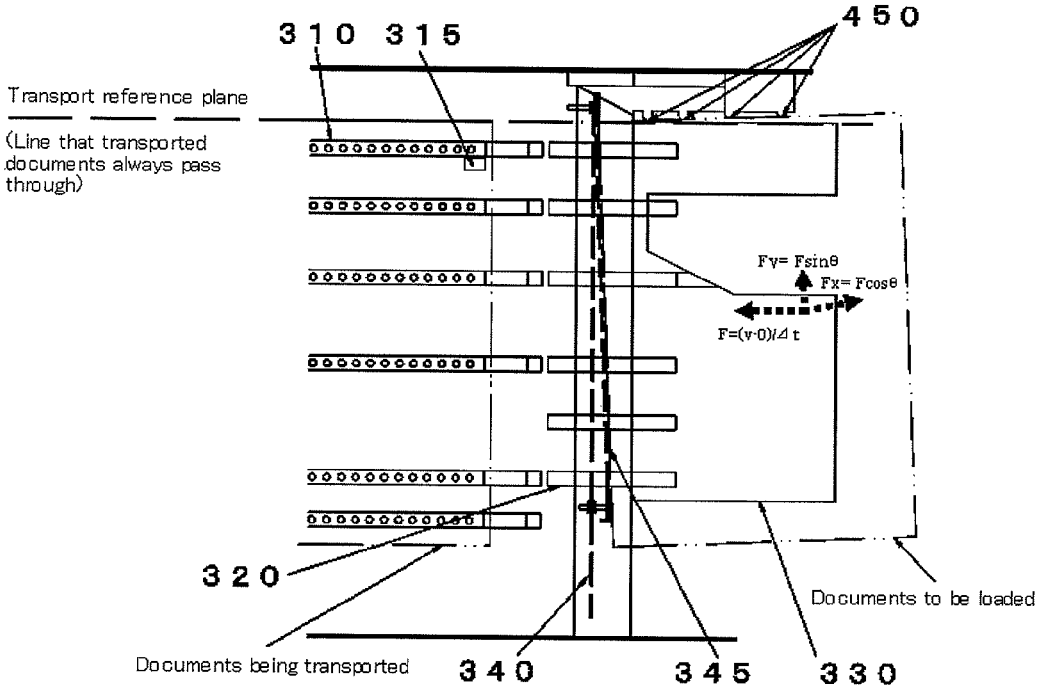
Figure 3:
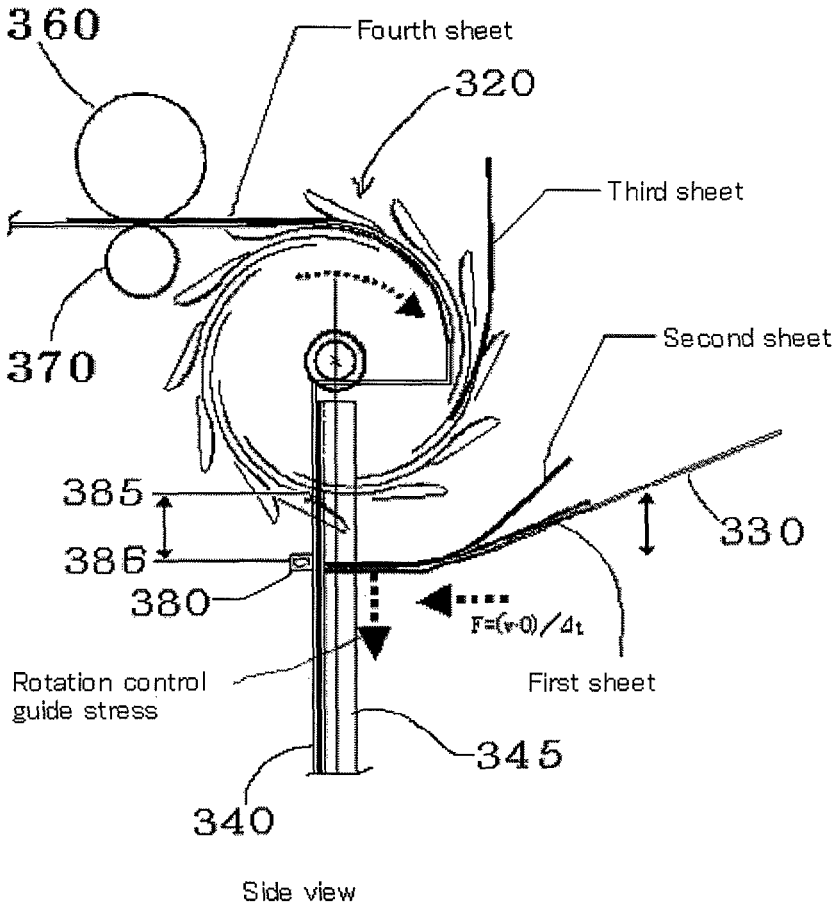
FIG. 3 is a side view mainly explaining loading functions of the paper ejector of the document processing device according to the present embodiment.

A detailed example of the paper ejector 300 of this embodiment including the above mechanisms is described with reference to FIGS. 2A, 2B and 3 hereafter. FIGS. 2A and 2B are a diagram mainly explaining functions of a transporting surface of the paper ejector 300 of the document processing device according to this embodiment. FIG. 3 is a side view mainly explaining loading functions of the paper ejector 300 of the document processing device according to this embodiment. Upper and lower rollers 360 and 370 for bringing documents into the paper ejector 300 are omitted from FIGS. 2A and 2B.

In FIGS. 2A, 2B and 3, reference numeral 310 denotes a transport belt for suctioning documents and transporting them, air inlets are provided at predetermined intervals, and the documents are adhered to the transport belt 310 and transported by rotating the belt (moving from the left side to the right side in the drawing) while suctioning from the bottom.

Reference numeral 315 denotes an optical sensor, which detects arrival of the documents to the paper ejector 300. The upper and lower rollers 360 and 370 shown in FIG. 3 are provided at predetermined intervals at document detecting positions of the optical sensor 315, detecting when documents being transported have reached the positions of the upper and lower rollers 360 and 370.

Reference numeral 320 denotes an inversion wheel, which has nail parts in a spiral teeth form formed all around the perimeter and holds the transporting documents by the nail parts clamping them with a friction force. The inversion wheel inverts the transport direction of the documents as it rotates while the transporting documents inserted between the nail parts are held, and loads them on the elevator tray 330. For example, assuming acceptance of documents up to size A4 with a 64-mm square, a 12-teeth wheel form is used.

In this embodiment, angle (angle of a tooth) between nail parts is set to 30 degrees. However, the angle (angle of a tooth) between nail parts is not limited to 30 degrees, and needless to say an arbitrary angle may be used as long as it has a structure that can hold and invert documents by frictional force between the nails and documents when the documents are clamped therebetween. The angle (angle of a tooth) between nail parts is not particularly limited and may be 20 degrees, 40 degrees, even 45 degrees or more.

Moreover, to prevent business forms supported by the inversion wheel 320 in a round form from hitting a rotation control guide 345 and rebounding, the inversion wheel 320 supporting the business forms is given a structure such that grooves of the wheel become narrower as they approach the center so that a constant frictional force is generated.

Reference numeral 330 denotes an elevator tray or a holding means for loading documents that are being transported thereto. It is lowered as the documents are loaded so that the top surface position of the documents is always nearly constant. Reference numeral 340 denotes a paper ejector housing to which the elevator tray 330 and the inversion wheel 320 of the paper ejector 300 are attached. The inversion wheel 320 is attached to the upper portion at predetermined intervals and the rotation control guide 345 is fixed to a standing part therebelow. Moreover, the elevator tray 330 is also raised along the paper ejector housing 340 in the same manner. Note that the paper ejector housing 340 has a structure having cutouts where the nails of the inversion wheel 320 are arranged so that the inversion wheel 320 is capable of rotating freely.

Reference numeral 345 denotes a rotation control guide or a second guiding mechanism, which has cutouts where the rotating parts of the inversion wheel 320 are located. It controls the front position of documents clamped between the nail parts of the inversion wheel 320 so as to remove the documents therefrom and load them on the elevator tray 330. Reference numeral 450 denotes a side guide member or a first guiding mechanism, which has a structure that positions a side of the documents that are being transported so as to load them on the elevator tray 330.

In this embodiment, the rotation control guide 345 as described later is provided at a predetermined further tilted angle than orthogonal angle to the transporting direction. In the example of FIGS. 1A and 1B, and FIGS. 2A and 2B, it is provided such that the front end (near side in FIGS. 1A, 1B, 2A and 2B) is tilted (inclined) so as to protrude toward the upstream side. Since the rotation control guide 345 is provided such that the front end (the side guide member 450 side is the base) is tilted so as to protrude upstream in this manner, a mechanism is employed which is capable of applying pressure in an Fy direction to the documents being transported and applying a turning force (force pressing the documents toward the side guide member 450) to the documents mainly on portions that abut the documents first so as to position the front end side of the documents using the rotation control guide 345 and position a side of the documents orthogonal to the front end side using the side guide member 450, thereby positioning and aligning two sides of the documents and loading them onto the elevator tray 330.

Note that while the rotation control guide 345 protrudes a predetermined angle on the upstream side from the base on the side guide member 450 side toward the front end in the example of FIG. 2B, the present invention has a configuration that is not limited to this angle, and the angle can be freely changed in conformity with specifications of the documents to be transported in an actual equipment. For example, in the case of firm and small-sized paper, the angle of gradient may be increased, and in the opposite case of unfirm paper or large-sized paper, the angle may be decreased. In this embodiment, from the perspective of reasonably maintaining the turning force in accordance with type of business forms or paper specified by the specifications, the rotation control guide is provided tilted approximately 5 degrees from the orthogonal direction with the front end side positioned so as to protrude upstream.

Note that in the above description, the rotation control guide 345 is not limited to the example of providing it such that the front end side protrudes upstream, where alternatively the base side may protrude upstream. Moreover, the rotation control guide 345 may be fixed on the side guide member 450 side or it may be fixed on the other side.

Reference numeral 380 denotes a loaded-paper top-surface detection sensor for detecting the top surface position of documents loaded on the elevator tray 330. Adjustment of the position of the loaded-paper top-surface detection sensor 380 allows arbitrary adjustment of distance between a detection surface 386 of the loaded-paper top-surface detection sensor 380 and a position 385 where documents being transported are removed from the nail parts of the inversion wheel 320.

Operation of the paper ejector of this embodiment provided with the above structure is described below.

When the optical sensor 315 detects a document, the document being transported has reached the positions of the upper and lower rollers 360 and 370, the upper and lower rollers 360 and 370 clamp the document, transporting using a transport belt is changed over to transporting to the inversion wheel 320 using the upper and lower rollers 360 and 370, and the document is clamped between nails of the inversion wheel 320. This state is represented as 'fourth sheet' in FIG. 3.

Once the transported document is between the nails of the inversion wheel 320 and a given length of time has passed, the inversion wheel 320 is rotated only an angle proportionate to width of the document being transported. For example, in the case of an A4 size document with a width of 210 mm, the wheel is rotated by a distance of three teeth and then stops. The state at this point is a state where the document transported first is represented as 'third sheet' in FIG. 3 and the subsequent document transported is represented as 'fourth sheet'.

Moreover, the subsequent document is transported to the position of the optical sensor 315, put in the inversion wheel 320, and after a given length of time has passed, the inversion wheel 320 is rotated again (in the case of an A4 size document, it is rotated by a distance of three teeth as in the above case.)

At this time, the front end side of the first document has reached the position of the rotation control guide 345, further movement is controlled, and the document is gradually removed from between the nails of the inversion wheel 320 and drops down on the elevator tray 330 along the rotation control guide 345. This is in a state represented as 'second sheet' in FIG. 3. The other transported documents are in states represented as 'third sheet' and 'fourth sheet', respectively.

Since the rotation control guide 345 is provided at a predetermined tilted angle so the near side in FIG. 2B protrudes on the upstream side when viewed from the transport direction, the front edge of the transported documents first abuts the protruding portion on the upstream side, transporting of this portion is controlled, and a state where transporting on the side of the side guide member 450 or upper portion in the diagram is not controlled occurs. As a result, Fy is applied to the documents along the angle of the rotation control guide 345, and it operates so as to rotate and be pressed toward the side guide member 450 such that the other side of the documents is guided by the side guide member 450.

In this manner, according to this embodiment, not only is the pressure in the Fy direction applied to the documents being transported along the angle of the rotation control guide 345 for controlling transporting of documents, but also is a pressure Fx, which is applied to the rotation control guide 345, applied to the documents being transported, which are thereby pressure-contacted to the side guide member 450, so as to position two sides of the documents, and a repulsive force F acts from the rotation control guide 345 so as to align the documents being transported from the paper ejector 300 and load them on the elevator tray 330.

As a result, since the transported documents are first abutted and pressed by the near side (front end side) of the rotation control guide 345 in FIG. 2B, the pressure Fy for rotating the documents on the side guide member 450 side along a misaligned angle from orthogonal angle to the transport path of the rotation control guide 345 is applied to press the documents in the direction of the side guide member, and the documents being transported are guided by two sides provided by the rotation control guide 345 and the side guide member 450.

Namely, the rotation control guide 345 or transport control means for halting transporting of documents is provided not at the orthogonal angle to the transporting direction but with a configuration where a side end on the front end side of the documents being transported is abutted so as for the documents to rotate with the first portion to be abutted as the supporting point, and by rotating the documents in the direction of the side guide member with the abutted portion as the supporting point, a force for pressing the documents for which the transporting direction has been inverted to the side guide member is applied.

Moreover, in this embodiment, the rotation control guide 345 not only detaches the document from the nail parts at a position indicated by reference numeral 385 in FIG. 3, but also controls positions until loading the documents on the elevator tray 330. As with conventional document processing devices, such as a printer or a copying machine, for example, a mechanism of not dropping documents freely on the elevator tray 330 but lowering them along the surface of the rotation control guide 345 is employed so as to load the documents on the elevator tray 330 while maintaining an aligned state.

More specifically, since the documents that are clamped by the inversion wheel 320 drop down by gravitation considerably when they are pressure-contacted by the rotation control guide 345 so as to remove them from the inversion wheel 320, the rotation control guide 345 is fixed to the paper ejector housing 340 at an angle of 60 degrees to 90 degrees so that they even drop while being guided by the rotation control guide 345 after being removed therefrom.

The reason for tilting at an angle of 60 degrees or more is that the nail parts of the inversion wheel are provided with twelve teeth at 30 degree intervals, where the 30 degree angle needs to be maintained. Moreover, this is because when exceeding 90 degrees (vertical), the documents are in a freely dropping state after they are removed from the inversion wheel 320, aligned documents may spread while dropping.

Furthermore, since the possibility that a strong frictional force occurs when the documents are dropping in the case where the rotation control guide 345 is tilted greater than the vertical direction is undeniable, it can be confirmed in this embodiment that, for example, the rotation control guide is tilted at approximately 85 degrees (state of protruding approximately 5 degrees in front) and the documents are loaded on the elevator tray 330 while maintaining an aligned state.

However, it is not limited to the above example, and needless to say, an arbitrary angle may be employed as long as the state where the front end side of the aligned documents are positioned by making contact with the rotation control guide as they drop is maintained (as long as the state where the aligned state can be maintained such as keeping a state that the front end side of the documents touches the rotation control guide). For example, a tilt of 89 degrees may be used, or 85 degrees or less is also possible in the case of a smooth surface finish or when the documents are firm and sliding property of the front end side is good.

In this manner, two sides of the transported documents are guided while being supported by the nail parts of the inversion wheel 320 by tilting the rotation control guide 345 in the lateral (horizontal) direction on the upstream side of the transporting direction, thereby making it possible to load them on the elevator tray 330 in an aligned manner.

Alternatively, by tilting the rotation control guide 345 in the longitudinal (vertical) direction at a predetermined angle, once the documents moving at high-speed while being clamped by the inversion wheel 320 are pressure-contacted to the rotation control guide 345, they can be lowered along the surface of the rotation control guide and loaded on the elevator tray 330 while maintaining the aligned state of the documents.

Further alternatively, it is more desirable in this embodiment to provide a structure where repulsive force from the rotation control guide 345 is controlled (reduced) when lowering the documents along the surface of the rotation control guide 345. For example, a structure where an elastic material is placed in the center portion to absorb force applied to the surface may be provided. The elastic material may be constituted by deploying a spongy material or an elastic material such as rubber and deploying a metal plate that is assured of a surface smoothness given below for only the abutting surface with the documents.

That is, the abutting surface with the documents is configured by a polished metal plate or a composite of a metal plate and a raw material such as tetrafluoroethylene plastic or the like, so that the documents slide easily when being lowered along the surface of the rotation control guide 345. This assures smoothness of the surface, and achieves control of influence of frictional resistance when the documents are being lowered to the elevator tray 330 without resistance to a negligible level.

INDUSTRIAL APPLICABILITY

The above description gives an example of a device for reading images of documents being transported and using that read image information later so as to process the information expressed on those documents.

However, the present invention is not limited to the above example, and is applicable to any device as long as it transports documents and loads a predetermined number of them collectively. For example, it may be applied to a device requiring a function of transporting documents and loading them.

The present invention may be applied to a device that transports documents that have been printed using a printing mechanism and loads them on a printed document stacker successively, or a composite machine where a printer and a reader are integrated and then printed or read documents are transported and loaded. Further, it is applicable to a device that transports and processes many documents and loads them on a document stacker, for example, a device that reads information expressed on document surfaces using OCR, OMR, etc., and then transports and loads the documents that have been read.

DESCRIPTION OF REFERENCE NUMERALS

50A, B, C: Transported document
100: Paper feeder (feeder)
200: Reader
300: Paper ejector (stacker)
315: Optical sensor
320: Inverse wheel
330: Elevator tray
340: Paper ejector housing
345: Rotation control guide
360: Upper roller
370: Lower roller
380: Loaded-paper top-surface detection sensor
400: Side guide
450: Side guide member

The invention claimed is:

1. A document processing device, which is provided downstream from a document transport path and successively loads documents being transported, said document processing device comprising:

a document inverter for inverting a transport direction of the documents being transported along the document transport path and obtaining inverted documents;

a first guider that is provided in nearly the same direction as a transport direction and positions a first front end side of the inverted documents;

a second guider that is provided so as to nearly intersect the transport path from a base of the first guider side, halts transport of the inverted documents, and positions a second front end side of the inverted documents orthogonal to the first front end side, and is provided to further tilt at a predetermined angle than orthogonal angle to the transport direction; and a holder for loading and holding the documents positioned by the first guider and the second guider, wherein a side end on the second front end side of respective documents inverted and held by the document inverter is abutted to the second guider so as to control transport of an abutting portion, a turning force being applied to the respective documents along the predetermined angle centering around the abutting portion as a base point, such that the respective documents are pressed toward the first guider side and are pressure-contacted by the second guider which is orthogonally arranged to the first guider, thereby positioning the respective documents using the first front end side as an abutting side to the first guider and the second front end side as an abutting side to the second guider, detaching the respective documents from the document inverter as detached documents while maintaining a positioned state, and loading the detached documents on the holder.

2. The document processing device according to claim 1, wherein a surface of the second guider is constituted by a tabular abutting surface which abuts the second front end side of the transported documents and is configured by a metal plate having an elastic material arranged on the back surface and a polished front surface such that when stacking on the holder the documents positioned by the first guider and the second guider, the documents slide down to the holder keeping the state of being positioned.

3. The document processing device according to claim 2, wherein the document inverter comprises a plurality of spiral teeth boards, which comprise document clamping nail parts extending a constant length in a spiral form from the vicinity of the central part of a disc-like board and having grooves for clamping the respective documents which become narrower towards the central part, formed along the entire perimeter at predetermined intervals and rotatable corresponding to document width, clamps the respective documents being transported between the document clamping nail parts of the spiral teeth boards so as to rotate the respective documents, controls rotation of the respective documents by abutting the respective documents to the second guider, and lowers the respective documents to the holder deployed at the bottom of the second guider, after detaching the respective documents from the document clamping nail parts.

4. The document processing device according to claim 2, further comprising a controller which controls such that distance between the top surface of the documents that are loaded on the holder and a position where the respective documents are separated from the document inverter and start lowering is kept within a predetermined range.

5. A document processing method for a document processing device that is provided downstream from a document transport path and successively loads documents being transported on a holder, said method comprising:

inverting by a document inverter a transport direction of the documents being transported along the document transport path to obtain inverted documents;

positioning a first front end side of the inverted documents by a first guider provided in nearly the same direction as a transport direction of the documents when stacking the documents being transported through the document transport path;

halting transport of the documents being transported by abutting the documents inverted and held by the document inverter to a second guider that is provided to nearly intersect the transport path of the documents, halts transport of the documents being transported, positions a second front end side of the inverted documents orthogonal to the first front end side, and is provided to further tilt at a predetermined angle than orthogonal angle to the transport direction; and loading and holding the documents positioned by the first guider and the second guider, wherein a side end on the second front end side of respective documents inverted and held by the document inverter is abutted to the second guider so as to control transport of the abutting portion, a turning force being applied to the respective documents along the predetermined angle centering around the abutting portion as a base point, such that the respective documents are pressed toward the first guider side and are pressure-contacted by the second guider which is orthogonally arranged to the first guider, thereby positioning the respective documents using the first front end side as an abutting side to the first guider and the second front end side as an abutting side to the second guider, detaching the respective documents from the document inverter as detached documents while maintaining a positioned state, and loading the detached documents on the holder.

6. The document processing method according to claim 1, wherein when loading the documents, control is performed such that distance between the top surface of the documents that are loaded on the holder and a position where the documents are separated from document clamping nail parts of the document inverter and start lowering is kept within a predetermined range.

* * * * *

UNITED STATES PATENT AND TRADEMARK OFFICE

CERTIFICATE OF CORRECTION

PATENT NO. : 9,120,639 B2
APPLICATION NO. : 14/359174
DATED : September 1, 2015
INVENTOR(S) : Kuriyama et al.

It is certified that error appears in the above-identified patent and that said Letters Patent is hereby corrected as shown below:

In the Claims
Claim 6 (Column 12, line 22): replace "1" with "5"

Signed and Sealed this
Tenth Day of May, 2016

Michelle K. Lee

Michelle K. Lee
*Director of the United States Patent and Trademark Office*